US005491649A

United States Patent [19]

Friday, Jr. et al.

[11] Patent Number: 5,491,649

[45] Date of Patent: Feb. 13, 1996

[54] CONFIGURATIVE CONTROL FOR HVAC SYSTEMS

[75] Inventors: Arthur F. Friday, Jr.; Chi-Ping Chan, both of Liverpool; Brett A. Desmarais, Cicero, all of N.Y.

[73] Assignee: Carrier Corporation, Syracuse, N.Y.

[21] Appl. No.: 143,029

[22] Filed: Oct. 29, 1993

[51] Int. Cl.[6] ..... G05B 13/00

[52] U.S. Cl. ..... 364/579; 62/211; 165/13

[58] Field of Search ..... 364/579, 138, 364/557, 571.04, 474.12; 62/211, 215; 165/13, 27

[56] References Cited

U.S. PATENT DOCUMENTS 4,573,115 2/1986 Halgrimson ..... 364/138
4,997,617 3/1991 Newton et al. ..... 364/579
5,043,926 8/1991 Naka et al. ..... 364/138
5,291,190 3/1994 Scarola et al. ..... 364/138

*Primary Examiner*—Ellis B. Ramirez
*Assistant Examiner*—Thomas Peeso

[57] ABSTRACT

Programmable system and process are disclosed for adapting a generally written HVAC control program to a number of different HVAC systems. The system and process include a separate interface to the control program and a separate interface to the control elements of each particular HVAC system. Configuration data for the particular HVAC system defines the relationship between software variables of the control program and the control elements of the particular HVAC system. The configuration data is utilized when information is to be transferred between the interfaces.

19 Claims, 4 Drawing Sheets

CONFIGURATION MAP– CHILLER UNIT 10

| S/W VARIABLE | S/W CHANNEL | H/W CHANNEL | H/W ELEMENT |
|---|---|---|---|
| LWT | 1 | 1 | 70 |
| EWT | 2 | 2 | 62 |
| FAN1 | 3 | 3 | 40 |
| FAN2 | 4 | 4 | 38 |
| FAN3 | 5 | 0 | – |
| FAN4 | 6 | 0 | – |
| COMP_1 | 7 | 5 | 22 |
| COMP_2 | 8 | 6 | 20 |
| COMP_3 | 9 | 0 | – |
| COMP_4 | 10 | 0 | – |
| COMP_FD_BK_1 | 11 | 7 | 22 |
| COMP_FD_BK_2 | 12 | 8 | 20 |
| COMP_FD_BK_3 | 13 | 0 | – |
| COMP_FD_BK_4 | 14 | 0 | – |

CONFIGURATION MAP– CHILLER UNIT 14

| S/W VARIABLE | S/W CHANNEL | H/W CHANNEL | H/W ELEMENT |
|---|---|---|---|
| LWT | 1 | 1 | 74 |
| EWT | 2 | 2 | 68 |
| FAN1 | 3 | 3 | 54 |
| FAN2 | 4 | 4 | 52 |
| FAN3 | 5 | 5 | 50 |
| FAN4 | 6 | 6 | 48 |
| COMP_1 | 7 | 7 | 36 |
| COMP_2 | 8 | 8 | 34 |
| COMP_3 | 9 | 9 | 32 |
| COMP_4 | 10 | 10 | 30 |
| COMP_FD_BK_1 | 11 | 11 | 36 |
| COMP_FD_BK_2 | 12 | 12 | 34 |
| COMP_FD_BK_3 | 13 | 13 | 32 |
| COMP_FD_BK_4 | 14 | 14 | 30 |

FIG.3A

CONFIGURATION MAP– CHILLER UNIT 12

| S/W VARIABLE | S/W CHANNEL | H/W CHANNEL | H/W ELEMENT |
|---|---|---|---|
| LWT | 1 | 1 | 72 |
| EWT | 2 | 2 | 64 |
| FAN1 | 3 | 3 | 46 |
| FAN2 | 4 | 4 | 44 |
| FAN3 | 5 | 5 | 42 |
| FAN4 | 6 | 0 | – |
| COMP_1 | 7 | 6 | 28 |
| COMP_2 | 8 | 7 | 26 |
| COMP_3 | 9 | 8 | 24 |
| COMP_4 | 10 | 0 | – |
| COMP_FD_BK_1 | 11 | 9 | 28 |
| COMP_FD_BK_2 | 12 | 10 | 26 |
| COMP_FD_BK_3 | 13 | 11 | 24 |
| COMP_FD_BK_4 | 14 | 0 | – |

FIG.3B

CONFIGURATIVE CONTROL FOR HVAC SYSTEMS

BACKGROUND OF THE INVENTION

This invention relates to the programmed control of heating and cooling systems utilizing one or more programmed microprocessors. In particular, this invention relates to the manner in which the programmed control in the microprocessors interfaces with various elements in the heating and cooling systems.

Programmed control of heating and cooling systems using microprocessors is well known. The programmed control normally includes stored instructions which either send or await the receipt of communications from various elements in the heating and cooling systems. These elements include temperature sensors, control valves, as well as fan and compressor motors. In each instance, an input or output (I/O) channel associated with the microprocessor is specifically identified in the software for use in communicating with a particular element. When communication is to take place, the element either receives an output signal or transmits an input signal over the designated I/O channel. The programmed control within the microprocessor proceeds on the assumption that all control functions are being properly executed by the elements.

The above described program control can pose problems when making any changes to the software residing in the microprocessor. In this regard, one must maintain an accurate accounting at all times of the I/O channel assignments to the elements when making any changes or revisions to the software.

One must also be careful when attempting to use the program control for what is believed to be a similar heating and cooling system having a similar configuration of elements. In this regard any differences in the elements in the second system must be carefully noted in the instructions for these particular elements.

OBJECTS OF THE INVENTION

It is an object of the invention to provide a programmable control for a heating or cooling system wherein changes may be easily made to the software affecting one or more elements in the system.

It is another object of the invention to provide a programmable control for a general configuration of hardware elements in a heating or cooling system that may be easily adapted to a number of different versions of the system.

SUMMARY OF THE INVENTION

The above and other objects are achieved by providing a programmed control for a heating or cooling system wherein the control software can be completely designed without regard to performing actual communications with hardware elements. This is achieved by providing software channel assignments to the software variables in the programmed control that may have communication relationships with hardware elements. The actual assignment of the software variables to hardware elements is done separately by system configuration software which maps the software channel assignments to identified hardware I/O channels. This configuration software is invoked only at such times as the software executing in the microprocessor has a need to perform a communication with a hardware element. The configuration software is preferably invoked on an interrupt basis or at the end of a pass through execution of the control software. In either event the configuration software proceeds to receive communications on I/O channels from the hardware elements and matches these communications with software variables having software channels that have been mapped to the hardware I/O channels. The configuration software may alternatively transmit communications over I/O channels to various hardware elements by noting which hardware I/O channels correspond with a software channel associated with a given software variable.

In accordance with the invention, the mapping of software channels to the hardware channels can be changed at anytime. Changes can occur either as a result of tailoring the software to a different configuration of hardware elements or as a result of adding capabilities to an existing configuration of hardware elements.

BRIEF DESCRIPTION OF THE DRAWINGS

Other objects and advantages of the present invention will be apparent from the following description in conjunction with the accompanying drawings in which:

FIG. 2 illustrates a microprocessor configuration for one of the control units of FIG. 1;

FIGS. 3A–3C illustrate configuration data for each of the control units of FIG. 1.

DESCRIPTION OF THE PREFERRED EMBODIMENT

Figure 1:
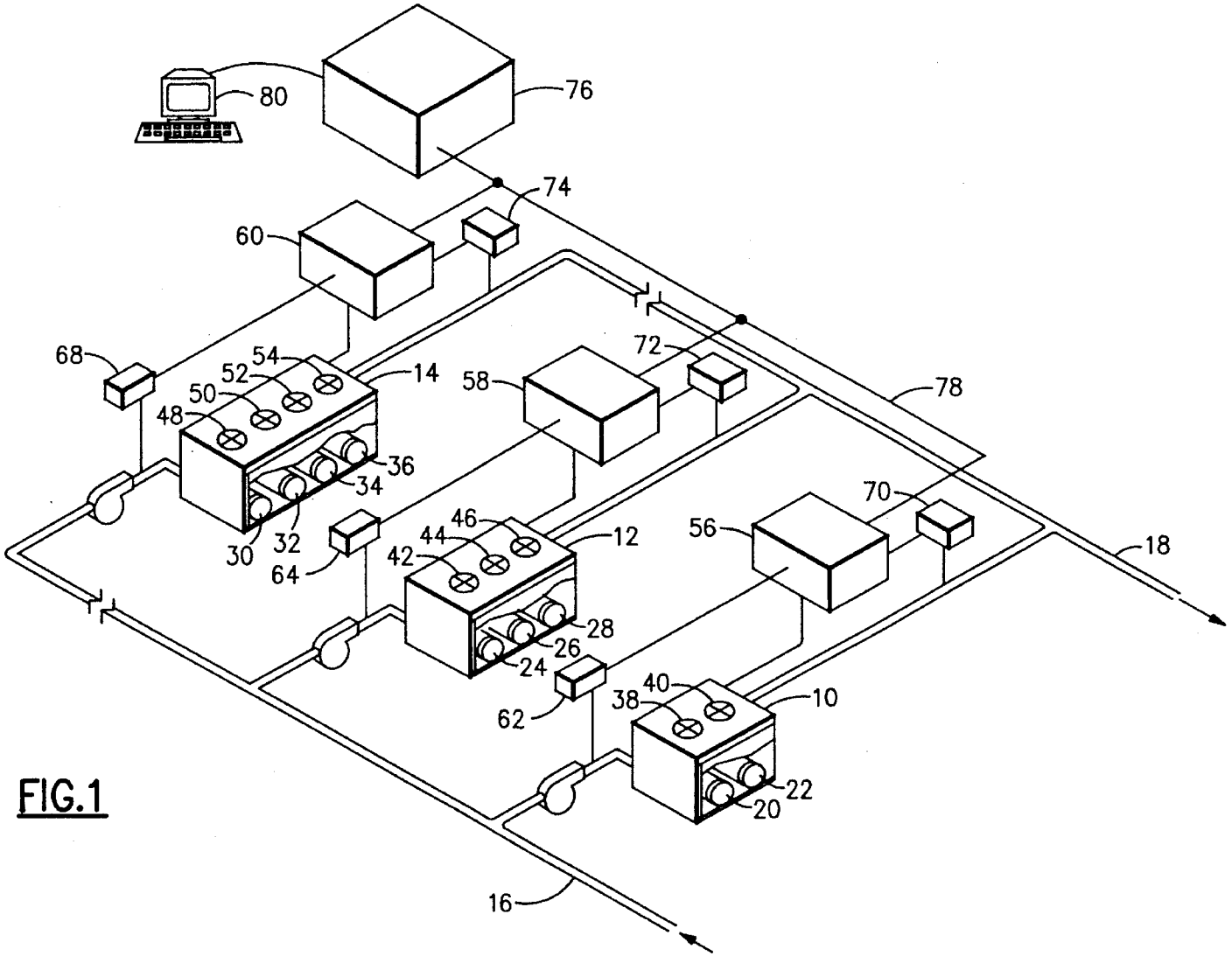
FIG. 1 illustrates a plurality of individually controlled chiller units each having a plurality of compressor stages and fan units operating under the control of respective control units.

Referring to FIG. 1, a number of parallel chiller units 10, 12, and 14 are illustrated relative to a coolant return line 16 and a coolant supply line 18. The coolant circulates through a series of heat exchangers (not shown) which effectively cool one or more spaces. The coolant returns to the system via the coolant return line. The coolant will hereinafter be referred to as chilled water although it should be understood that the system would work equally well with other coolants. The chiller units 10, 12, and 14 are typically required to maintain the leaving coolant at the same temperature.

Each of the chiller units is seen to include individual compressor stages such as 20 and 22 for chiller unit 10; 24, 26 and 28 for chiller unit 12; and 30, 32, 34 and 36 for chiller unit 14. Each of the chiller units also includes fans such as 38 and 40 for chiller unit 10; 42, 44, and 46 for chiller unit 12; and 48, 50, 52 and 54 for chiller unit 14. The compressor stages and fans in each respective chiller unit are individually controlled by a unit controller such as 56 for chiller unit 10, 58 for chiller unit 12, and 60 for chiller unit 14. Each unit controller receives an entering water temperature from a respective entering water temperature sensor 62, 64, or 68. Each unit controller also receives a leaving water temperature from a respective leaving water temperature sensor 70, 72 or 74. It is to be understood that each unit controller activates the number of compressor stages within the chiller unit so as to achieve a desired leaving water temperature for its respective branch of the system of FIG. 1. This local control may be in accordance with any number of well known control methods for activating or deactivating compressors and associated fans in order to achieve the desired leaving water temperature. In addition to controlling the respective chiller unit, each unit controller communicates with a system controller 76 via a communication bus 78.

The system controller 76 downloads control programs into the respective unit controllers 56, 58, and 60 via the communication bus 78. These control programs each contain the same algorithms for the control of the fans and compressors in each chiller unit. The downloaded control programs are configured for each chiller unit by separately loaded configuration data for each unit controller. As will be explained in detail hereinafter, the separately loaded configuration data defines relationships between the software variables in the control program common to each unit controller and the actual hardware elements that are to be controlled in each chiller unit. This allows the common control program in each unit controller to execute without regard to the actual number of fans and compressors in each chiller unit. It is to be noted that the downloading of the various software modules to the individual unit controllers can be done in response to commands from a user interface 80 associated with the system controller 76.

Figures 2, 3C:
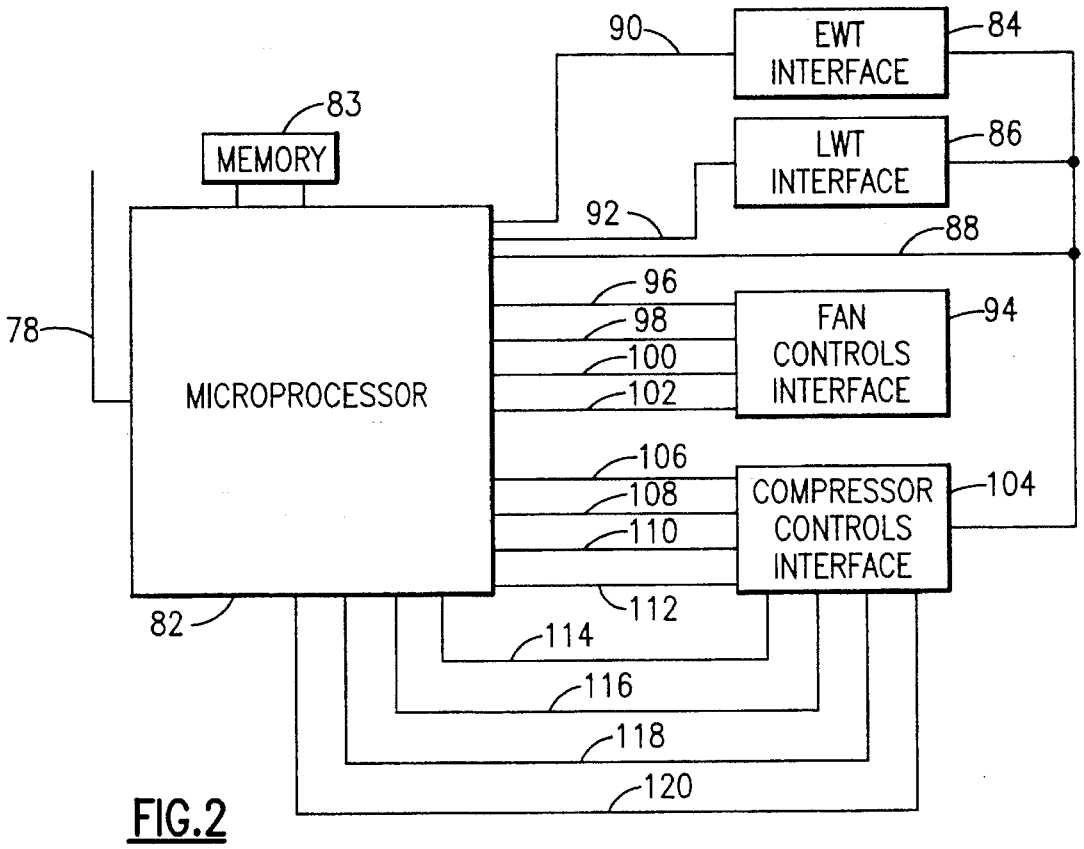

FIG. 2 illustrates a unit controller in further detail. Each unit controller includes a programmed microprocessor 82 which receives the downloaded software from the system controller 76 via the communication bus 78. The downloaded software is stored in a memory 83 for execution by the microprocessor. The microprocessor 82 furthermore communicates with various digital to analog interfaces illustrated in FIG. 2. In particular, the microprocessor 82 receives temperature information from either an entering water temperature interface 84 or a leaving water temperature interface 86. It is to be appreciated that each interface is connected to a leaving water temperature sensor or an entering water temperatures sensor for the particular control unit. Each interface is operative to produce an interrupt signal over an interrupt communication line 88 when a temperature update is to be provided to the microprocessor 82. The microprocessor is operative to read the temperature value via a hardware input line 90 or 92.

The microprocessor is also connected to a fan control interface 94. The fan control interface 94 receives output signals from the microprocessor over the lines 96, 98,100, and 102 which activate respective fans in a chiller unit through the fan control interface 94. The microprocessor also is interconnected to a compressor control interface 104 via a set of output lines 106, 108, 110 and 112 as well as a set of feedback lines 114, 116, 118 and 120. The compressor control interface 104 is operative to send an interrupt signal over the line 88 to the microprocessor 82 in the event that a feedback to the microprocessor 82 is in order. The compressor control interface will otherwise receive output signals from the microprocessor 82 via the lines 106 through 112.

It is to be appreciated that each of the interfaces 84, 86, 94 and 104 are directly connected to the corresponding hardware elements in FIG. 1. As has been previously noted, the number of hardware elements to which the unit controller connects will vary depending on the chiller. In this regard, both chiller units 10 and 12 have less fans and less compressors than chiller unit 14. This will mean less active connections to fans and compressors by the fan control interface 94 and the compressor control interface 104 in the unit controllers 56 and 58 for chiller units 10 and 12 versus the unit controller 60 for the chiller unit 14.

Notwithstanding the number of active connections to individual fans and compressors, each unit controller will preferably include the same type of microprocessor having the same control program stored in its memory. The control program will have a complete set of software variables that govern the control of the maximum number of temperature sensors, fans and compressors. In order for the control program to control various numbers of sensors, fans and compressors, configuration data is provided by the system controller 76 to the microprocessor 82. This configuration data is stored for use in the local memory 83. Referring to FIG. 3A, the configuration data for the chiller unit 14 is illustrated in detail. The configuration data is seen to include a column of software variables which includes leaving water temperature LWT, entering water temperature EWT, fan software controls variables labeled FAN1 to FAN4, compressor control variables COMP_1 through COMP_4 and COMP_FD_BK_1 through COMP_FD_BK_4. Each of the software variables is denoted by a particular software channel index number. Each software channel index number is in turn related to a hardware channel index number. The hardware channels correspond to the various connecting lines to the various interfaces 84, 86, 94 and 104 in FIG. 2 which in turn connect to specific hardware elements such as is shown in FIG. 3A. For example, hardware channel one for the leaving water temperature sensor 74 is line 92 in FIG. 2. This hardware channel is mapped to the software channel one denoting the software variable LWT. In similar fashion, the compressor control 36 has input lines 106–112 corresponding to the hardware channel lines seven through ten that are mapped to the software channels seven through ten identifying the compressor variables COMP_1 through COMP_4.

Referring to FIG. 3B, the configuration data for the chiller unit 12 is illustrated in detail. It will be remembered that the chiller unit 12 does not contain a fourth fan or a fourth compressor. The hardware channel index assignments for the fourth fan control variable FAN4, and the compressor variables COMP_4 and COMP_FD_BK4, are all numerically coded with a value of zero. Furthermore, beginning with the software variable COMP_1, the numerical value of the hardware channel index assignment does not directly correspond with the numerical value of the software channel index assignment. This means that the software channel index numbers will map to different hardware channel index numbers from this point.

Referring to FIG. 3C, the configuration data for the chiller unit 10 even further departs from a direct correspondence between the numerical value of the hardware channel index and that of the software channel index. In particular, since the chiller unit 10 has only two fan controls and two compressors, the hardware channel indexes for the third and fourth fans as well as the third and fourth compressors are all equal to zero. It is hence to be appreciated that the control program executing in the unit controller 56 associated with the chiller unit 10 will have significantly less non-zero hardware channel indexes than the unit controllers 58 and 60.

As has been previously noted, the configuration data for each respective chiller unit is loaded into the memory 83 associated with the microprocessor 82 of the corresponding unit controller. The configuration data is preferably organized in two ways in memory. First, storage locations are set aside for each software channel index along with the value for the particular software variable represented by the software channel index and the corresponding hardware channel index number. Secondly, storage locations are set aside for each hardware channel index along with the current values that have been either communicated to or received from the appropriate analog to digital interfaces for that hardware channel index. The software channel index number is also stored in a storage location linked to the hardware channel index number. In this manner, a search query can be made by either set of index numbers to find the appropriate configuration data.

Figure 4:
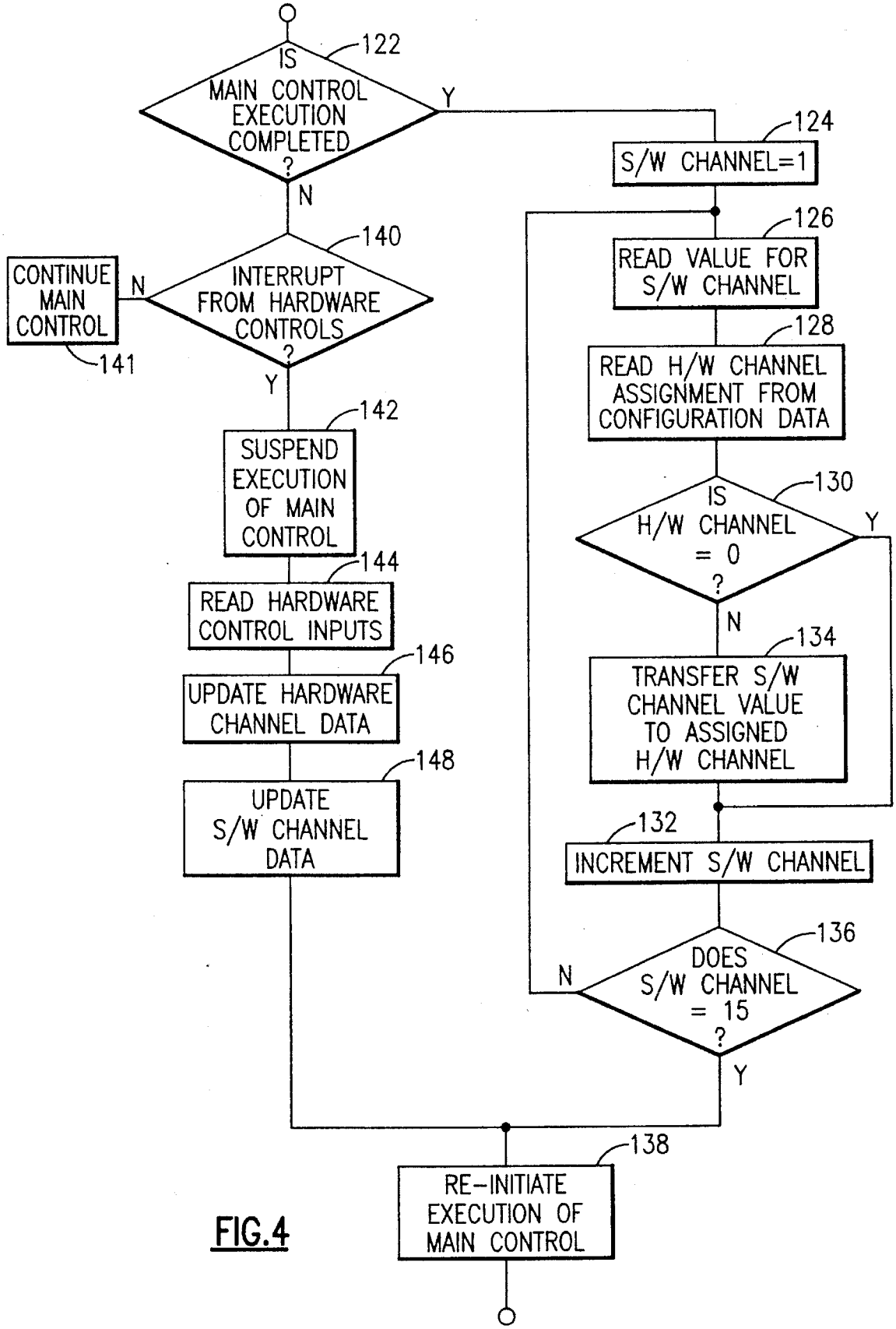
FIG. 4 illustrates a configuration program executed by each microprocessor within a control unit of FIG. 1.

Referring to FIG. 4, a program utilizing the stored configuration data is illustrated in detail. This program begins with a step 122 wherein the question is asked as to whether the control program execution is complete. It is to be appreciated that the control program will normally cause the microprocessor to calculate various values of the software control variables during execution. Completion of these calculations will result in the microprocessor exiting from the step 122 to a step 124 and setting a software channel index equal to one. The value of the software variable corresponding to this software channel index is read in a step 126. The hardware channel index assignment for the software channel index is next read in a step 128. The thus read hardware channel index is checked for being equal to zero in step 130. In the event that the hardware channel assignment is equal to zero, the microprocessor proceeds from step 130 to a step 132 and increments the software channel index by one. In the event that the hardware channel index is not equal to zero, the microprocessor proceeds to a step 134 and transfers the software channel value read in step 126 to a storage location in memory 83 associated with the assigned hardware channel identified in step 128. The software channel is thereafter incremented in step 132. The thus incremented software channel index is checked for being equal to fifteen in a step 136. It is to be appreciated that the value for each software channel index will be successively read and transferred to a storage location in memory 83 associated with the assigned hardware channel index. This will continue until the software channel index is incremented from fourteen to fifteen in step 132. When this occurs, the microprocessor will proceed out of step 136 to a step 138 and reinitiate execution of the control program for the particular chiller unit. At this time, the control program will again calculate any values for the software variables associated with the various software channel indexes. At the same time, each of the interfaces 84, 86, 94 and 104 will have access to the updated hardware channel values stored in the memory 83 for use by the respective hardware elements.

Referring to FIG. 2, it will be remembered that an interface may generate an interrupt signal on the line 88 when it wishes to communicate with the microprocessor 82. This may occur at anytime during execution of the control program.

Referring to FIG. 4, the status of line 88 is continuously monitored during control program execution by a step 140. When no interrupt is noted, the microprocessor simply continues to execute the control program as noted in step 141. When an interrupt is received from one of the interfaces, the microprocessor will proceed to a step 142 and suspend execution of the control program. Suspension of the control program is done in a manner which allows the control program to complete execution of any particular series of steps that are necessary before termination. This would include for instance performing a complete calculation of the value of a particular software variable and storing the results thereof before terminating control. When the control program has signaled that it has completed its termination procedure, the microprocessor will proceed to a step 144 and read the hardware control input signal lines. These would be the signal lines associated with the leaving water temperature sensor, entering water temperature sensor, and the feedback signals from the individual compressors within the given chiller unit. For instance, the feedback signal for compressor number one in chiller unit 14 would be stored in a storage location associated with the hardware channel index eleven whereas the same first compressor feedback signal value would be stored in a storage location associated with hardware channel index nine for chiller unit 12 and in a storage location associated with hardware channel index seven for chiller unit 10. Following the updating of all hardware channel input data, the microprocessor will proceed to a step 146 and update all corresponding software channel data. This will involve reading the value stored under the hardware channel index and storing that value under the corresponding software channel index. Following the updating of all corresponding software channel input data, the microprocessor will proceed to step 138 and again reinitiate execution of the control program. Execution within the control program will normally begin at the point where the control was previously interrupted. The control of each chiller unit will be dictated by the same control program. The control program will in each instance either use presently stored software channel values or calculate new software channel values as dictated by the control program. While this is occurring, the interfaces 84, 86, 94, and 104 shown in FIG. 2 for a given microprocessor will have the benefit of the values currently stored under the appropriate hardware channel indexes.

It is to be appreciated that the configuration data and configuration program used for the unit controllers 56, 58 and 60 of FIG. 1 could also be used in any particular control system environment wherein a generally written control program is to be used for the control of a number of different HVAC systems. In this regard, a control program may be written for a series of different HVAC systems and loaded into the controller for any of these HVAC systems along with configuration data defining the particular relationship between the software elements of the control program and the hardware elements of the system. Communications between the hardware elements and the software elements would be facilitated by software similar to that illustrated in FIG. 4.

It is to be appreciated that a particular embodiment of the invention has been described. Alterations, modifications, and improvements thereto will readily occur to those skilled in the art. Such alterations, modifications, and improvements are intended to be part of this disclosure even though not expressly stated herein. Accordingly the foregoing description is by way of example only. The invention is limited only as defined in the following claims and the equivalents thereto.

What is claimed is:

1. In a system having a plurality of individual heating or cooling units, each having a programmable control unit including a processor and memory associated therewith, the programmable control unit interfacing with a set of discrete elements that implement the prescribed heating or cooling of the individual heating or cooling unit, a process executable by the processors in at least two programmable control units comprising the steps of:

controlling the heating or cooling to be performed by the heating or cooling unit through a control program common to the control program in at least the one other control unit, the control program being stored in the memory associated with the processor in each programmable control unit, the control program stored in the memory associated with the processor in each programmable control unit having a set of control variables identical to the control variables of the control program stored in the memory of the processor in the other programmable control unit, the control variables in each control program having program control values that vary from time to time as the control program is repeatedly executed by the processor; and accessing configuration data stored in the memory associated with the processor in each programmable control unit when communication of control values is to occur between the programmable control unit and the discrete elements that implement the prescribed heating or cooling, the configuration data comprising a set of first indicia corresponding to the control variables wherein each particular first indicia corresponds to a particular control variable, and a set of second indicia corresponding to the discrete elements that are actually present in the particular heating or cooling unit wherein each particular second indicia corresponds to a particular discrete element, and wherein the configuration data further comprises stored associations of said second indicia linked to respective first indicia whereby each second indicia is linked to a respective first indicia, said step of accessing configuration data comparing the steps of:

using a first indicia to identify a linked second indicia corresponding to a particular discrete element when communication of a program control value is initiated by the programmable control unit; and using a second indicia corresponding to a particular discrete element so as to identify a linked first indicia corresponding to a particular control variable when communication of a control value is initiated by the particular discrete element.

2. The process of claim 1 wherein the memory associated with the processor includes a set of first storage locations set aside for storing program control values for the control variables in the control program, each stored program control value in a first storage location being associated with the particular first indicia corresponding to the control variable for the stored program value, and a set of second storage locations set aside for storing control values received from or communicated to the discrete elements, each stored control value in a second storage location being associated with the particular second indicia corresponding to the discrete element receiving or communicating the control value, the process further comprising the steps of:

transferring a program control value associated with a particular first indicia from a first storage location set aside for storing the program control value associated with the particular first indicia to a second storage location set aside for storing a control value associated with a second indicia linked to the particular first indicia when communication is initiated by the programmable control unit; and transferring a control value associated with a particular second indicia from a second storage location set aside for storing the control value associated with the particular second indicia to a first storage location set aside for storing the program control value associated with a first indicia linked to the particular second indicia when communication is initiated by a discrete element.

3. In a system having a plurality of individual heating or cooling unit, each having a programmable control unit including a processor and memory associated therewith, the programmable control unit interfacing with a set of discrete elements that implement the prescribed heating or cooling for the individual heating or cooling unit, a process executable by the processors in at least two programmable control units comprising the steps of:

controlling the heating or cooling to be performed by the heating or cooling unit through a control program common to the control program in at least the one other control unit, the control program being stored in the memory associated with the processor in each programmable control unit, the control program stored in the memory associated with the processor in each programmable control unit having a set of control variables identical to the control variables of the control program stored in the memory of the processor in the other programmable control unit, the control variables in each control program having program control values that vary from time to time as the control program is repeatedly executed by the processor;

accessing configuration data stored in the memory associated with the processor in each programmable control unit, the configuration data comprising a plurality of stored associations of particular control variables in the control program in each programmable control unit to particular discrete elements that implement the prescribed heating or cooling in the particular heating or cooling unit, each stored associated including one particular control variable linked to one particular discrete element so that particular control variables in the control program can be identified as being linked to particular discrete elements in the heating or cooling unit when communication of control values is to occur between the programmable control unit and the discrete elements that implement the prescribed heating or cooling;

wherein the memory associated with the processor includes a set of first storage locations set aside for storing the program control values of the control variables in the control program, each stored program value in a first storage location being associated with the particular control variable for the stored program control value, and a set of second storage locations set aside for storing control values received from or communicated to the discrete elements, each stored control value in a second storage location being associated with the particular discrete element receiving or communicating the control value; and wherein said step of controlling the heating or cooling to be performed by the heating or cooling unit includes the steps of:

calculating through the control program a program control value for at least one control variable, noting when the calculation of a program control value for the control variable is complete; and wherein said step of accessing configuration data includes the steps of:

accessing the configuration data comprising the plurality of stored associations of particular control variables to particular discrete elements so as to identify the particular discrete element calculated program control value, and transferring the calculated program control value from a first storage location set aside for storing the calculated program control value associated with the control variable to a second storage location set aside for storing a control value associated with the identified discrete element linked to the control variable.

4. In a system having a plurality of individual heating or cooling units, each having a programmable control unit including a processor and memory associated therewith, the programmable control unit interfacing with a set of discrete elements that implement the prescribed heating or cooling for the individual heating or cooling unit, a process executable by the processors in at least two programmable control units comprising the steps of:

controlling the heating or cooling to be performed by the heating or cooling unit through a control program common to the control program in at least the one other control unit, the control program being stored in the memory associated with the processor in each programmable control unit, the control program stored in the memory associated with the processor in each programmable control unit having a set of control variables identical to the control variables of the control program stored in the memory of the processor in the other programmable control unit, the control variables in each control program having program control values that vary from time to time as the control program is repeatedly executed by the processor;

accessing configuration data stored in the memory associated with the processor in each programmable control unit, the configuration data comprising a plurality of stored associations of particular control variables in the control program in each programmable control unit to particular discrete elements that implement the prescribed heating or cooling in the particular heating or cooling unit, each stored association including one particular control variable linked to one particular discrete element so that particular control variables in the control program can be identified as being lined to particular discrete elements in the heating or cooling unit when communication of control values is to occur between the programmable control unit and the discrete elements that implement the prescribed heating or cooling; and wherein the memory associated with the processor includes a set of first storage locations set aside for storing the program control values of the control variables in the control program, each stored program control value in a first storage location being associated with the particular control variable for the stored program control value, and a set of second storage locations set aside for storing control values received from or communicated to the discrete elements, each stored control value in a second storage location being associated with the particular discrete element receiving or communicating the control value; and wherein said step of controlling the heating or cooling to be performed further includes the steps of:

interrupting the processor within the programmable control unit when a control value is to be transmitted from a discrete element, storing the control value in a second storage location set aside for storing the control value from the discrete element transmitting the control value, and wherein said step of accessing configuration data includes the steps of:

accessing the configuration data comprising stored associations of particular control variables linked to discrete elements so as to identify the particular control variable linked to the discrete element transmitting the control value, and transferring the control value associated with the discrete element transmitting the control value from the second storage location set aside for storing the control value associated with the discrete element transmitting the control value to the first storage location set aside for storing the program control value associated with the particular control variable linked to the discrete element.

5. A system having a plurality of individual heating or cooling units, each heating or cooling unit having a programmable control unit interfacing with a set of discrete elements that implement the prescribed heating or cooling for the individual heating or cooling unit, wherein at least two of the programmable control units each comprise:

a processor;

a memory associated with said processor;

a control program common to the control program in at least the one other control unit, the control program being stored in the memory associated with the processor of the programmable control unit and executable by the processor so as to control the heating or cooling to be performed by the heating or cooling unit through communications of control values between the processor and the discrete elements that implement the prescribed heating or cooling, the control program including a set of control variables having program control values that vary from time to time as the control program is repeatedly executed by the processor;

configuration data stored in the memory associated with the processor in the programmable control unit, the configuration data comprising a set of first indicia corresponding to the control variables in the control program wherein each particular first indicia corresponds to a particular control variable, a set of second indicia corresponding to the discrete elements that are actually present in the particular heating or cooling unit wherein each particular second indicia corresponds to a particular discrete element, and wherein the configuration data further comprises stored associations of said second indicia linked to respective first indicia; and a configuration program stored in the memory associated with the process which allows the processor to access the configuration data comprising stored associations of said second indicia linked to first indicia so that particular control variables in the control program having corresponding first indicia can be identified as being lined to particular discrete elements having corresponding second indicia when communications of control values is to occur between the programmable control unit and the discrete elements that implement the prescribed heating or cooling.

6. The system of claim 5 wherein said set of second indicia furthermore include specially coded indicia indicating the lack of presence of certain discrete elements in the particular heating or cooling unit.

7. A system having a plurality of individual heating or cooling units, each heating or cooling unit having a programmable control unit interfacing with a set of discrete elements that implement the prescribed heating or cooling for the individual heating or cooling unit, wherein at least two of the programmable control units each comprise:

a processor;

a memory associated with said processor;

a control program common to the control program in at least the one other control unit, the control program being stored in the memory associated with the processor of the programmable control unit and executable by the processor so as to control the heating or cooling to be performed by the heating or cooling unit through communications of control values between the processor and the discrete elements that implement the prescribed heating or cooling, the control program including a set of control variables having program control values that vary from time to time as the control program is repeatedly executed by the processor;

configuration data stored in the memory associated with the processor in the programmable control unit, the configuration data comprising a plurality of stored associations of particular control variables in the control program to particular discrete elements that implement the prescribed heating or cooling in the particular heating or cooling unit, each stored associations including one particular control variable linked to one particular discrete element;

a set of first storage locations, set aside in the memory associated with said processor, for storing the program control values of the control variables in the control program, each stored program control value in a first storage location being associated with the particular control variable for the stored program control value;

a set of second storage locations, set aside in the memory associated with said processor, for storing control values received from or communicated to the discrete elements, each stored control value in a second storage location being associated with the particular discrete element receiving or communicating the control value; and a configuration program stored in the memory associated with the processor which allows the processor to access the configuration data comprising stored associations of particular control variables to particular discrete elements so that particular control variables in the control program can be identified as being lined to particular discrete elements when communication of control values is to occur between the programmable control unit and the discrete elements that implement the prescribed heating or cooling, said configuration program comprising:

an instruction for noting when the control program has completed the updating of any program control values for any control variables, an instruction for accessing the configuration data comprising stored associations of particular control variables to particular discrete elements so as to identify the particular discrete elements linked to the particular control variables having updated program control values, and an instruction for transferring the updated program control values from first storage locations set aside for storing the updated program control values associated with the control variables to second storage locations set aside for storing control values associated with the identified discrete elements.

8. A system having a plurality of individual heating or cooling units, each heating or cooling unit having a programmable control unit interfacing with a set of discrete elements that implement the prescribed heating or cooling for the individual heating or cooling unit, wherein at least two of the programmable control units each comprise:

a processor;

a memory associated with said processor;

a control program common to the control program in at least the one other control unit, the control program being stored in the memory associated with the processor of the programmable control unit and executable by the processor so as to control the heating or cooling to be performed by the heating or cooling unit through communications of control values between the processor and the discrete elements that improvement the prescribed heating or cooling, the control program including a set of control variables having program control values that vary from time to time as the control program is repeatedly executed by the processor;

configuration data stored in the memory associated with the processor in the programmable control unit, the configuration data comprising a plurality of stored associations of particular control variables in the control program to particular discrete elements that implement the prescribed heating or cooing in the particular heating or cooling unit, each stored association including one particular control variable linked to one particular discrete element;

a set of first storage locations, set aside in the memory associated with said processor, for storing the program control values of the control variables in the control program, each stored program control value in a first storage location being associated with the particular control variable for the stored program control value, a set of second storage locations, set aside in the memory associated with said processor, for storing control values received from or communicated to the discrete elements, each stored control value in a second storage location being associated with the particular discrete element receiving or communicating the control value; and a configuration program stored in the memory associated with the processor which allows the processor to access the configuration data comprising stored associations of particular control variables to particular discrete elements so that particular control variables in the control program can be identified as being linked to particular discrete elements when communication of control values is to occur between the programmable control unit and the discrete elements that implement the prescribed heating or cooling, said configuration program comprising:

an instruction for interrupting the processor executing the control program when a control value is to be transmitted from a discrete element;

an instruction for storing the control value in a second storage location set aside for storing the control value from the discrete element transmitting the control value, an instruction for accessing the configuration data comprising stored associations of particular control variables linked to particular discrete elements so as to identify the particular control variable linked to the discrete element transmitting the control value and, an instruction for transferring the control value associated with the discrete element transmitting the control value from the second storage location set aside for storing the control value associated with the discrete element transmitting the control value to the first storage location set aside for storing the program control value associated with the particular control variable linked to the discrete element.

9. In a heating or cooling system having a programmable control units including a processor and memory associated therewith, the programmable control unit interfacing with a set of discrete elements that implement the prescribed heating or cooling for the system, a process executable by the processor within the programmable control unit comprising the steps of:

controlling the heating or cooling to be performed by the heating or cooling system through a set of control variables having program control values that vary from time to time as the control program is repeatedly executed; and accessing configuration data stored in the memory associated with the processor in the programmable control unit when communication of control values is to occur between the programmable control unit and the discrete elements of the heating or cooling system, the configuration on data comprising a set of first indicia corresponding to the control variables wherein each particular first indicia corresponds to a particular control variable and a set of second indicia corresponding to the discrete elements that are actually present in the particular heating or cooling unit wherein each particular second indicia corresponds to a particular discrete element, and wherein the configuration data further comprises stored associations of said second indicia linked to respective first indicia whereby each second indicia is linked to a respective first indicia, said step of accessing configuration data further comprising the steps of:

using a first indicia to identify a linked second indicia corresponding to a particular discrete element when communication is initiated by the programmable control unit; and using a second indicia corresponding to a particular element so as to identify a linked first indicia corresponding to a particular control variable when communication of a control value is initiated by the particular discrete element.

10. The process of claim 9 wherein the memory associated with the processor includes a set of first storage locations set aside for storing program control values for the control variables in the control program, each stored program control value in a first storage location being associated with the particular first indicia corresponding to the control variable for the stored program value, and a set of second storage locations set aside for storing control values received from or communicated to the discrete elements, each stored control value in a second storage location being associated with the particular second indicia corresponding to the discrete element receiving or communicating the control value, the process further comprising the steps of:

transferring a program control value associated with a particular first indicia from a first storage location set aside for storing the program control value associated with the particular first indicia to a second storage location set aside for storing a control value associated with a second indicia linked to the particular first indicia when communication of a control value is initiated by the programmable control unit; and transferring a control value associated with a particular second indicia from a second storage location set aside for storing the control value associated with the particular second indicia to a first storage location set aside for storing the program control value associated with a first indicia linked to the particular second indicia when communication of a control value is initiated by a discrete element.

11. In a heating or cooling system having a programmable control unit including a processor and memory associated therewith, the programmable control unit interfacing with a set of discrete elements that implement the prescribed heating or cooling for the system, a process executable by the processor within the programmable control unit comprising the steps of:

controlling the heating or cooling to be performed by the heating or cooling system through a set of control variables having program control values that vary from time to time as the control program is repeatedly executed; and accessing configuration data stored in the memory associated with the processor in the programmable control unit, the configuration data comprising;

and wherein said step of controlling the heating or cooling to be performed by the heating or cooling unit includes the step of:

calculating through the control program a program control value for at least one control variable, noting when the calculating of the program control value for the control variable is complete; and wherein said step of accessing configuration data includes the steps of:

accessing the configuration data comprising the plurality of stored associations of particular control variables to particular discrete elements so as to identify the particular discrete element linked to the control variable having the calculated program control value, and transferring the calculated program control value from a first storage location set aside for storing the calculated program control value associated with the control variable to a second storage location set aside for storing a control value associated with the identified discrete element linked to the control variable.

12. In a heating or cooling system having a programmable control unit including a processor and memory associated therewith, the programmable control unit interfacing with a set of discrete elements that implement the prescribed heating or cooling for the system, a process executable by the processor within the programmable control unit comprising the steps of:

controlling the heating or cooling to be performed by the heating or cooling system through a set of control variables having program control values that vary from time to time as the control program is repeatedly executed; and accessing configuration data stored in the memory associated with the processor in the programmable control unit, the configuration data comprising a plurability of stored associations of particular control variables to particular discrete elements of the heating or cooling system so that particular control variables can be identified as being linked to particular discrete elements in the heating or cooling system when communication of control values is to occur between the programmable control unit and the discrete elements of the heating or cooling system;

wherein the memory associated with the processor includes a set of first storage locations set aside for storing program control values of the control variables in the control program, each stored program control value in a first storage location being associated with the particular control variable for the stored program control value, and a set of second storage locations set aside for storing program control values received from or communicated to the discrete elements, each stored control value in a second storage location being associated with the particular discrete element receiving or communicating the control value;

and wherein said step of controlling the heating or cooling to be performed by the heating or cooling unit includes the steps of:

interrupting the processor within the programmable control unit when a control value is to be transmitted form a discrete element, storing the control value in a second storage location set aside for storing the control value from the discrete element transmitting the control value;

and wherein said step of accessing configuration data includes the steps of:

accessing the configuration data comprising the plurality of stored associations of particular control variables to particular discrete elements so as to identify the particular control variable linked to the discrete element transmitting the control value; and transferring the control value associated with the discrete element transmitting the control value from the second storage location set aside for storing the control value associated with the discrete element transmitting the control value to a first storage location set aside for storing the program control value associated with the particular control variable linked to the discrete element.

13. A programmable control unit interfacing with a set of discrete elements within a heating or cooling system which implement the heating or cooling to be performed by the heating or cooling system said programmable control unit including:

a memory associated with said processor;

a control program stored in the memory associated with said processor, the control program being executable by the processor so as to control the heating or cooling to be performed by the system through communications of control values between the processor and the discrete elements that implement the prescribed heating or cooling, the control program including a set of control variables having program control values that vary from time to time as the control program is being repeatedly executed by the processor;

configuration data stored in the memory associated with the processor comprising a set of first indicia corresponding to the control variables in the control program wherein each particular first indicia corresponds to a particular control variable, and a set of second indicia corresponding to the discrete elements of the heating or cooling system, wherein each particular second indicia corresponds to a particular discrete element, and wherein the stored associations of particular control variables to particular control elements comprise stored associations of said second indicia linked to respective first indicia; and a configuration program stored in the memory associated with the processor which allows the processor to access the configuration data comprising a plurality of stored associations of said second indicia linked to first indicia so that particular control variables in the control program having corresponding first indicia can be identified as being lined to particular discrete elements having corresponding second indicia when communication of control values is to occur between the programmable control unit and the discrete elements of the heating or cooling system.

14. The system of claim 13 wherein said set of second indicia furthermore include specially coded indicia indicating the lack of presence of certain discrete elements in the particular heating or cooling unit.

15. A programmable control unit interfacing with a set of discrete elements within a heating or cooling system which implement the heating or cooling to be performed by the heating or cooling system said programmable control unit including:

a processor;

a memory associated with said processor;

a control program stored in the memory associated with said processor, the control program being executable by the processor so as to control the heating or cooling to be performed by the system through communications of control values between the processor and the discrete elements that implement the prescribed heating or cooling, the control program including a set of control variables having program controls values that vary from time to time as the control program is being repeatedly executed by the processor;

configuration data stored in the memory associated with the processor comprising a plurality of stored associations of particular control variables in the control program to particular discrete elements of the heating or cooling system, each stored association including one particular control variable linked to one particular discrete element;

a set of first storage locations, set aside in the memory associated with the processor, for storing the program control values of the control variables in the control program, each stored program control value in a first storage location being associated with the particular control variable for the stored program control value;

a set of second storage locations, set aside in the memory associated with the processor for storing control values received from or communicated to the discrete elements, each stored control value in a second storage location being associated with a discrete element receiving or communicating the control value; and a configuration program stored in the memory associated with the processor which allows the processor to access the configuration data comprising a plurality of stored associations of particular control variables to particular discrete elements so that particular control variables in the control program can be identified as being lined to particular discrete elements when communication of control values is to occur between the programmable control unit and the discrete elements of the heating or cooling system, said configuration program comprising:

an instruction for noting when the control program has completed the updating of any program control values for any control variables, an instruction for accessing the configuration data comprising stored associations of particular control variables to particular control elements so as to identify the particular discrete elements linked to the particular control variables having updated program control values; and an instruction for transferring the updated program control values from first storage locations set aside for storing the updated program control values associated with the control variables to second storage locations set aside for storing control values associated with the identified discrete elements.

16. A programmable control unit interfacing with a set of discrete elements within a heating or cooling system which implement the heating or cooling to be performed by the heating or cooing system said programmable control unit including:

a processor, a memory associated with said processor;

a control program stored in the memory associated with said processor, the control program being executable by the processor so as to control the heating or cooling to be performed by the system through communications of control values between the processor and the discrete elements that implement the prescribed heating or cooling, the control program including a set of control variables having program controls values that vary from time to time as the control program is being repeatedly executed by the processor;

configuration data stored in the memory associated with the processor comprising a plurality of stored associations of particular control variables in the control program to particular discrete elements of the heating or cooing system, each stored association including one particular control variable linked to one particular discrete element;

a set of first storage locations, set aside in the memory associated with the processor for storing the program control values of the control variables in the control program, each stored program control value in a first storage location being associated with the particular control variable for the stored program control value, and a set of second storage locations set aside for storing control values received from or communicated to the discrete elements, each stored control value in a second storage location being associated with the particular discrete element receiving or communicating the control value; and a configuration program stored in the memory associated with the processor which allows the processor to access the configuration data comprising a plurality of stored associations of particular control variables to particular discrete elements so that particular control variables in the control program can be identified as being lined to particular discrete elements when communication of control values is to occur between the programmable control unit and the discrete elements of the heating or cooling system, said configuration program comprising:

an instruction for interrupting the processor executing the control program when a control value is to be transmitted from a discrete element, an instruction for storing the control value in a second storage location set aside for storing the control value from associated with the discrete element transmitting the control value;

an instruction for accessing the configuration data comprising stored associations of particular control variables linked to particular discrete elements so as to identify the particular control variable linked to the discrete element transmitting the control value; and an instruction for transferring the control value associated with the discrete element transmitting the control value from the second storage location set aside for storing the control value associated with the discrete element transmitting the control value to the first storage location set aside for storing the program control value associated with the particular control variable linked to the discrete element.

17. A process for defining the heating or cooling to be performed by a heating or cooling system, said process being executable by a control unit in communication with discrete elements of the heating or cooling system via communication channels associated with the discrete elements, said process including a control program which computes control values for certain of the discrete elements based upon the receipt of control values from other discrete elements, the control program having control variables for the control values, said process further comprising the steps of:

creating identifications of each communication channel associated with a discrete element:

creating identifications of each control variable within the control program;

creating and storing mapped linkages between the identifications of control variables and the identifications of communication channels associated with discrete elements;

creating a series of first storage locations accessible by the control unit based upon the identifications of control variables;

creating a series of second storage locations accessible by the control unit based upon the identifications of communications channels associated with discrete elements;

storing control values received from the discrete elements in the series of second storage locations according to the identifications of communication channels associated with discrete elements;

storing at least one value computed for at least one control variable by the control unit executing the control program in one of the first storage locations according to the identification of the control variable;

transferring at least one control value stored in a second storage location to an identified first storage location by utilizing the stored mapped linkages; and transferring at least one value computed for at least one control variable from a first storage location to a second storage location utilizing the stored mapped linkages.

18. The process of claim 17 wherein said step of transferring at least one control value stored in a second storage location to an identified first storage location utilizing the stored mapped linkages comprises the steps of:

noting the identification of at least one communication channel associated with a discrete element communicating information to the control unit;

accessing the stored mapped linkage having the noted identification of the at least one communication channel;

reading the identification of the control variable linked by the stored mapped linkage to the at least one communication; and transferring the value stored in the second storage location associated with the noted identification of the at least one communication channel to the storage location associated with the read identification of the control variable.

19. The process of claim 17 wherein said step of transferring at least one value computed for at least one control variable from a first storage location to a second storage location comprises the steps of:

noting the identification of the control variable for which the value was computed;

accessing the stored linkage having the noted identification of the control variable for which the value was computed;

reading the identification of the communication channel associated with the discrete element linked to the noted identification of the control variable for which the value was computed: and transferring the value stored in the first storage location associated with the noted identification of the control variable for which the value was computed to the second storage location associated with the read identification of the communication channel.

* * * * *